US010655489B2

(12) United States Patent
Sarawate et al.

(10) Patent No.: US 10,655,489 B2
(45) Date of Patent: May 19, 2020

(54) SYSTEMS AND METHODS FOR ASSEMBLING FLOW PATH COMPONENTS

(71) Applicant: GENERAL ELECTRIC COMPANY, Schenectady, NY (US)

(72) Inventors: Neelesh Nandkumar Sarawate, Niskayuna, NY (US); Christopher Edward Wolfe, Niskayuna, NY (US); Victor John Morgan, Simpsonville, SC (US); Jason Ray Gregg, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/862,520

(22) Filed: Jan. 4, 2018

(65) Prior Publication Data

US 2019/0203606 A1 Jul. 4, 2019

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F05D 2220/32* (2013.01); *F05D 2230/60* (2013.01); *F05D 2240/12* (2013.01); *F05D 2240/55* (2013.01); *F05D 2240/80* (2013.01)

(58) Field of Classification Search
CPC ..... F01D 11/005; F01D 9/041; F01D 9/04; F01D 11/08; F01D 11/006; F05D 2220/32; F05D 2230/60; F05D 2240/55
USPC ..... 415/139
See application file for complete search history.

(56) References Cited

U.S. PATENT DOCUMENTS 4,662,658 A 5/1987 Holowach et al.
5,088,888 A 2/1992 Bobo
5,154,577 A * 10/1992 Kellock ..... F01D 11/005 277/641
5,221,096 A * 6/1993 Heldreth ..... F01D 11/005 277/630

(Continued)

OTHER PUBLICATIONS

Cholakian et al., "Mars Science Laboratory Roll Control System Thruster Seals", 2008 IEEE Aerospace Conference, pp. 1-6, 2008, Big Sky, MT.

(Continued)

*Primary Examiner* — Dwayne J White
*Assistant Examiner* — Adam W Brown
(74) *Attorney, Agent, or Firm* — Armstrong Teasdale LLP

(57) ABSTRACT

An assembly for a turbomachine and a method for assembling a plurality of flow path components are presented. The assembly includes a plurality of flow path components disposed adjacent to one another, each flow path component having a forward surface, an aft surface, a pressure side surface, and a suction side surface. A seal channel is defined by the pressure side surface and the suction side surface of adjacent flow path components. The seal channel has an open forward end proximate to the forward surfaces and at least two rear ends proximate to the aft surfaces. The assembly includes a plurality of seal layers disposed within the seal channel such that one or more seal layers extend from the open forward end to a rear end and one or more other seal layers extend from the open forward end to another rear end.

18 Claims, 6 Drawing Sheets

(56) References Cited

U.S. PATENT DOCUMENTS 5,249,920 A * 10/1993 Shepherd ..... F01D 11/005 415/134
5,868,398 A * 2/1999 Maier ..... F01D 11/005 277/643
5,988,975 A 11/1999 Pizzi
5,997,247 A * 12/1999 Arraitz ..... F01D 11/005 277/543
6,527,274 B2 3/2003 Herron et al.
6,561,764 B1 5/2003 Tiemann
6,637,752 B2 10/2003 Aksit et al.
7,484,936 B2 2/2009 Bouchard et al.
7,874,803 B2 1/2011 Whitton
7,901,186 B2 * 3/2011 Cornett ..... F01D 11/005 277/643
8,011,892 B2 9/2011 Ramlogan et al.
8,105,041 B2 1/2012 Brillert et al.
8,210,797 B2 * 7/2012 Dueckershoff ..... F01D 9/041 415/115
8,225,614 B2 7/2012 Lacy et al.
8,250,756 B2 8/2012 Adis et al.
8,276,649 B2 10/2012 Gagnon, Jr. et al.
8,545,181 B2 10/2013 Charlton
8,613,599 B2 12/2013 Lake et al.
8,794,640 B2 * 8/2014 Bergman ..... F01D 11/005 277/652
9,255,488 B2 2/2016 Szwedowicz et al.
9,500,095 B2 11/2016 Pietrobon et al.
9,664,057 B2 * 5/2017 Feldmann ..... F01D 9/04
9,970,308 B2 * 5/2018 Bergman ..... F01D 11/005
2002/0121744 A1 9/2002 Aksit et al.
2003/0039542 A1 2/2003 Cromer
2012/0119447 A1 5/2012 Demiroglu et al.
2012/0292860 A1 11/2012 Moehrle et al.
2013/0272849 A1 10/2013 Khanin et al.
2015/0037167 A1 2/2015 Simon-Delgado et al.
2015/0064012 A1 3/2015 Heaven et al.
2015/0125301 A1 5/2015 Headland
2015/0226077 A1 8/2015 Beattie et al.
2016/0003079 A1 * 1/2016 Boeke ..... F01D 11/005 415/1
2016/0061048 A1 3/2016 Corcoran et al.
2016/0215640 A1 * 7/2016 Bergman ..... F16J 15/0887
2016/0312635 A1 10/2016 Sarawate et al.
2017/0159479 A1 6/2017 Dev et al.
2018/0087394 A1 * 3/2018 Sarawate ..... F01D 11/005
2018/0106158 A1 * 4/2018 Boeke ..... F01D 9/041
2018/0355753 A1 * 12/2018 Groves, II ..... F01D 5/14

OTHER PUBLICATIONS

Huber et al., "Investigation of strip seal leakage with special focus on seal groove design and relative displacement of sealing surfaces", Proceedings of ASME Turbo Expo 2017: Turbomachinery Technical Conference and Exposition, Jun. 26-30, 2017, Charlotte, NC, USA, 8 Pages.

* cited by examiner

SYSTEMS AND METHODS FOR ASSEMBLING FLOW PATH COMPONENTS

BACKGROUND

The disclosure relates generally to systems and methods for assembling flow path components of turbomachines, and particularly, to systems and methods for sealing the flow path components for example, nozzles in gas turbines.

A turbomachine, such as an industrial, aircraft or marine gas turbine generally includes, in serial flow order, a compressor, a combustor and a turbine. The turbine has multiple stages with each stage including a row of turbine nozzles and an adjacent row of turbine rotor blades disposed downstream from the turbine nozzles. The turbine nozzles are held stationary within the turbine and the turbine rotor blades rotate with a rotor shaft. The various turbine stages define a hot gas path through the turbine.

During operation, the compressor provides compressed air to the combustor. The compressed air is mixed with fuel and burned in a combustion chamber or reaction zone defined within the combustor to produce a high velocity stream of hot gases. The hot gases flow from the combustor into the hot gas path of the turbine via a turbine inlet. As the hot gases flow through each successive stage, kinetic energy from the high velocity hot gases is transferred to the rows of turbine rotor blades, thus causing the rotor shaft to rotate and produce mechanical work.

A first stage of turbine nozzles and turbine rotor blades is positioned closest to the turbine inlet and is thus exposed to the highest hot gas temperatures. The first stage turbine nozzle includes an airfoil that extends in span between an inner band or shroud and an outer band or shroud. The inner band and the outer band define inner and outer flow boundaries of the hot gas path and are exposed to the hot gases. While assembling adjacent turbine nozzles, the resulting assembly may include small gaps between the shrouds of adjacent turbine nozzles, which could provide an undesirable fluid leak path. This has been a challenge sealing potential leak paths between adjacent turbine nozzles and doing so in a way that makes the assembly efficient and reliable.

BRIEF DESCRIPTION

One aspect of the disclosure provides an assembly of a turbomachine. The assembly includes a plurality of flow path components disposed adjacent to one another, each flow path component of the plurality of flow path components having a forward surface, an aft surface, a pressure side surface, and a suction side surface and a seal channel defined by the pressure side surface of a first flow path component of the plurality of flow path components and the suction side surface of a second flow path component of the plurality of flow path components and extending from the forward surfaces to the aft surfaces of the first and second flow path components, where the seal channel has an open forward end proximate to the forward surfaces and at least two rear ends proximate to the aft surfaces of the first and second flow path components and a plurality of seal layers disposed within the seal channel such that one or more seal layers of the plurality of seal layers extend from the open forward end to a rear end of the at least two rear ends and one or more other seal layers of the plurality of seal layers extend from the open forward end to another rear end of the at least two rear ends.

In one aspect of the disclosure, a method for assembling adjacent flow path components to form an assembly of a turbomachine is provided. The method includes the step of disposing a plurality of flow path components adjacent to each other, each flow path component of the plurality of flow path components having a forward surface, an aft surface, a pressure side surface, and a suction side surface such that a seal channel is defined by the pressure side surface of a first flow path component of the plurality of flow path components and the suction side surface of a second flow path component of the plurality of flow path components, which extends from the forward surfaces to the aft surfaces of the first and second flow path components and the seal channel has an open forward end proximate to the forward surfaces and at least two rear ends proximate to the aft surfaces of the first and second flow path components, inserting one or more seal layers into the seal channel through the open forward end to dispose the one or more seal layers extending from the open forward end to a rear end of the at least two rear ends and inserting a one or more other seal layers into the seal channel through the open forward end to dispose the one or more other seal layers extending from the open forward end to another rear end of the at least two rear ends.

These and other features, embodiments, and advantages of the present disclosure may be understood more readily by reference to the following detailed description.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
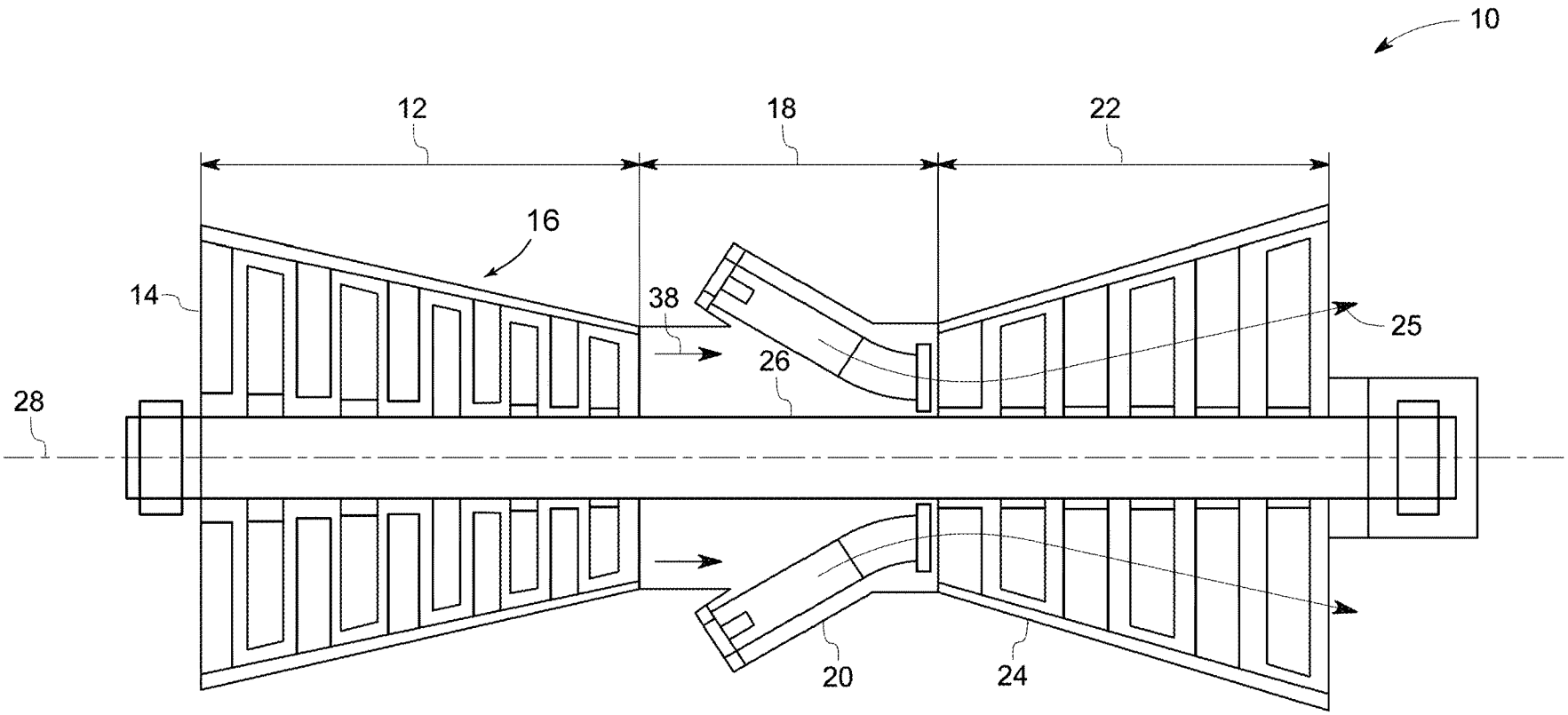
FIG. 1 is a schematic view of a gas turbine, in accordance with some embodiments of the disclosure.

It is noted that the drawings of the disclosure are not to scale. The drawings are intended to depict only typical aspects of the disclosure, and therefore should not be considered as limiting the scope of the disclosure.

DETAILED DESCRIPTION

Embodiments provided herein are directed to systems and methods for sealing adjacent flow path components to form an assembly for a turbomachine. The systems for sealing such as seal layers and methods of sealing, as described herein, advantageously provide improved ease and efficiency for installing the seal layers between flow path components and assembling an assembly, and desirable mechanical properties such as creep resistance, shear/torsional strength and thermal shock resistance at high temperatures in turbomachines. As discussed in detail below, some embodiments relate to an assembly such as a stator assembly of a gas turbine that includes a plurality of flow path components such as turbine nozzles disposed adjacent to one another.

Although exemplary embodiments of the present invention will be described generally in the context of a stator assembly for a land based power generating gas turbine for purposes of illustration, one of ordinary skill in the art will readily appreciate that embodiments of the present invention may be applied to any style or type of gas turbine and are not limited to land based power generating gas turbines unless specifically recited in the claims.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", is not limited to the precise value specified. In some instances, the approximating language may correspond to the precision of an instrument for measuring the value.

Unless defined otherwise, technical and scientific terms used herein have the same meaning as is commonly understood by one of skill in the art to which this disclosure belongs. The terms "comprising," "including," and "having" are intended to be inclusive, and mean that there may be additional elements other than the listed elements. The terms "first", "second", and the like, as used herein do not denote any order, quantity, or importance, but rather are used to distinguish one element from another. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

In some embodiments, an assembly of a gas turbine including a plurality of flow path components disposed adjacent to one another and a method of sealing adjacent flow path components for forming the assembly are described with reference to FIGS. 1-2.

Referring now to the drawings, FIG. 1 illustrates a schematic of a gas turbine 10 as may incorporate various embodiments of the present disclosure. As shown, the gas turbine 10 generally includes a compressor section 12 having an inlet 14 disposed at an upstream end of a compressor 16. The gas turbine 10 further includes a combustion section 18 having one or more combustors 20 positioned downstream from the compressor 16 and a turbine section 22 including a turbine 24 such as an expansion turbine is disposed downstream from the combustion section 18. A shaft 26 extends axially through the compressor 16 to the turbine 24 along an axis 28 of the gas turbine 10.

Figure 2:
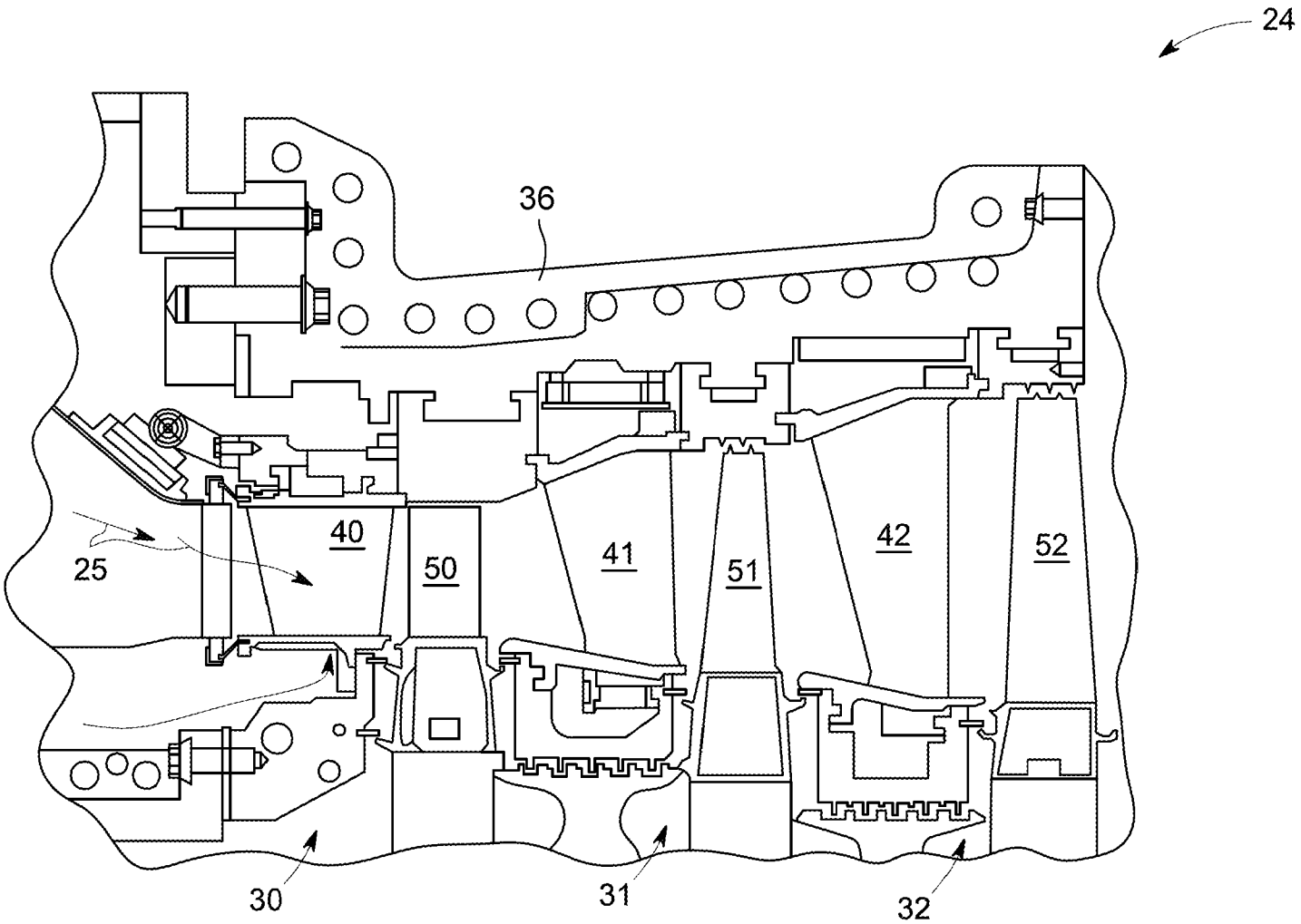
FIG. 2 is a cross sectional side view of a turbine section of a gas turbine, in accordance with some embodiments of the disclosure.

FIG. 2 provides a cross sectioned side view of the turbine 24 that may incorporate various embodiments of the present disclosure. The turbine 24 may include multiple turbine stages. As shown in FIG. 2, the turbine 24 may include three turbine stages including a first stage 30, a second stage 31 and a third stage 32. The total number of turbine stages may be more or less than three and embodiments of the present disclosure should not be limited to three turbine stages.

Each turbine stage (30, 31, 32) includes a corresponding stator assembly and a corresponding rotor assembly axially spaced along the axis 28 (FIG. 1). Each stator assembly includes a plurality of turbine nozzles disposed circumferentially adjacent to one another to form a ring structure. The cross sectioned side view of FIG. 2 shows, in serial flow order, the corresponding turbine nozzles 40, 41 and 42 of each stator assembly and the corresponding turbine rotor blades 50, 51 and 52 of each rotor assembly. A casing or shell 36 circumferentially surrounds each turbine stage (30, 31, and 32) of the turbine nozzles (40, 41 and 42) and the turbine rotor blades (50, 51 and 52). The turbine nozzles (40, 41, and 42) remain stationary relative to the turbine rotor blades (50, 51, and 52) during operation of the gas turbine 10.

In operation, as shown in FIGS. 1 and 2 collectively, compressed air 38 from the compressor 16 is provided to the combustors 20 where it is mixed with fuel and burned to provide a stream of hot combustion gases that flows from the combustors 20 into the turbine 24 in a flow path 25. At least a portion of the compressed air 38 may be used as a cooling medium for cooling the various components of the turbine 24.

Figure 3:
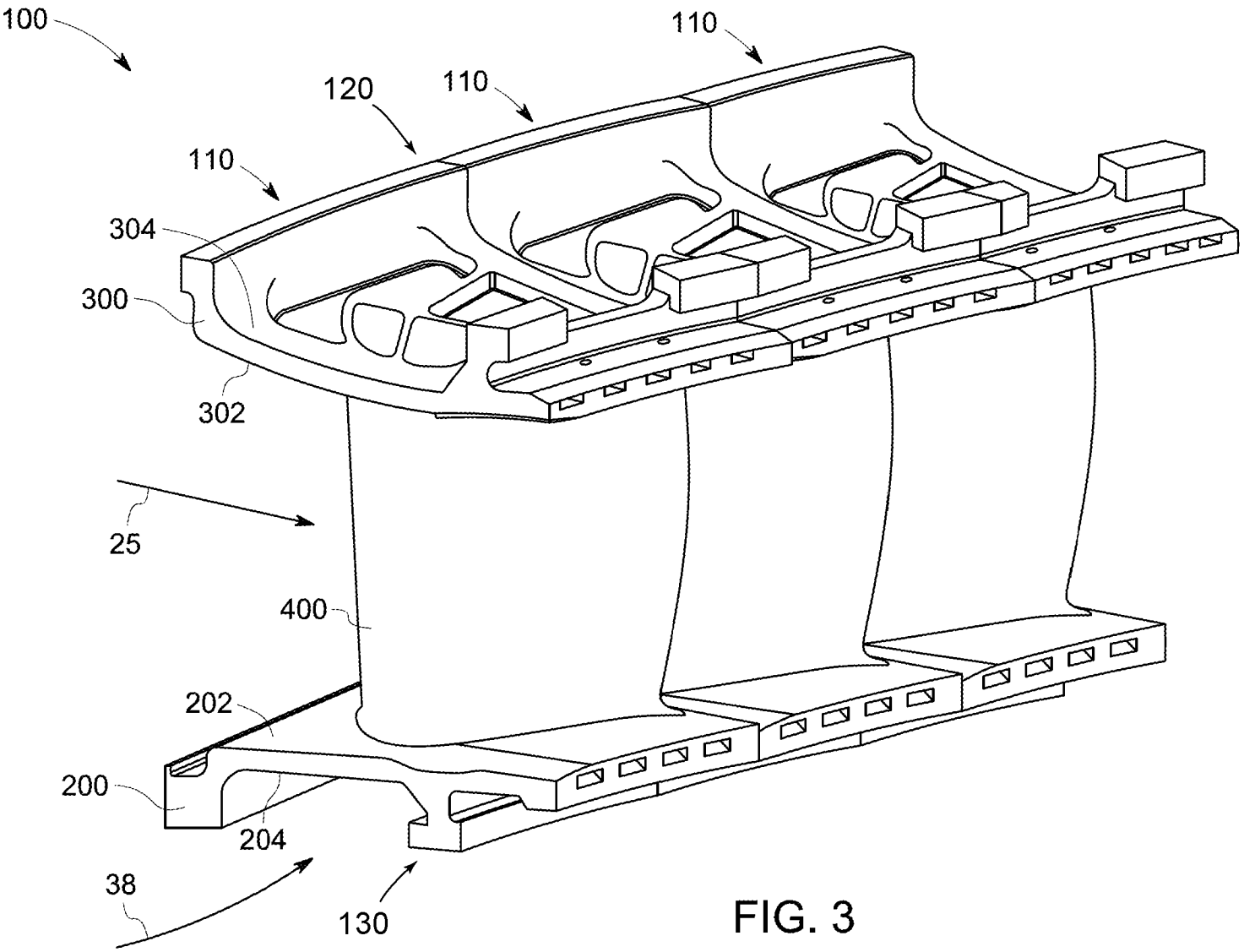
FIG. 3 is a perspective view of a portion of a stator assembly including a plurality of turbine nozzles disposed adjacent to one another, in accordance with some embodiments of the disclosure.

FIG. 3 shows a perspective view of a stator assembly 100 including a plurality of turbine nozzles 110 as may be incorporated into the turbine 24 as shown in FIG. 2 and as may incorporate various embodiments of the present disclosure. A turbine nozzle 110 may correspond with or be installed in place of any of turbine nozzles (40, 41, or 42). In some embodiments, the turbine nozzle 110 corresponds with the turbine nozzle 40 of the first stage 30 which may also be known in the industry as a stage-one nozzle or S1N.

As shown in FIG. 3, each turbine nozzle 110 includes an inner band 200, an outer band 300 that is radially spaced from the inner band 200 and an airfoil 400 that extends in span from the inner band 200 to the outer band 300. The airfoil 400, the inner band 200, and the outer band 300 of the turbine nozzle 110 are often manufactured as a single piece with a uniform base material (though they may undergo different machining, treatment, and coating processes). As illustrated, each adjacent turbine nozzle 110 is installed in the stator assembly 100 to form a circular structure. In the circular structure, the outer bands 300 and the inner bands 200 of adjacent turbine nozzles 110 form a solid outer ring 120 and a solid inner ring 130 (portions of the solid outer ring 120 and the solid inner ring 130 are shown in FIG. 3).

Each inner band 200 includes a gas-side surface 202 and a back-side surface 204 that is oriented radially inwardly from the gas-side surface 202. Each outer band 300 includes a gas-side surface 302 and a back-side surface 304 that is oriented radially outwardly from the gas-side surface 302. As shown in FIG. 3 the gas-side surface 302 of the outer band 300 and the gas-side surface 202 of the inner band 200 define inner and outer radial flow boundaries for a stream of hot combustion gases flowing at high velocity from the combustors 20 through the turbine 24. When the plurality of turbine nozzles 110 are assembled in the stator assembly 100, the inner bands 200 and outer bands 300 define inner and outer radial flow boundaries for the stream of hot combustion gases, the solid outer ring 120 and the solid inner ring 130 formed by the adjacent inner bands 200 and outer bands 300 of the plurality of turbine nozzles 110 should not allow a leakage through or between the adjacent inner bands 200 and outer bands 300. Similarly, other components in the flow path of a turbomachine may be assembled with an adjacent component and create an undesirable leak path absent a reliable seal. For example, shrouds, cover plates, spacers, near flow path seals (NFPS), and other components defining the desired flow path and which are assembled in pieces in some turbomachines may present similar seams between adjacent components in need of sealing.

Figure 4:
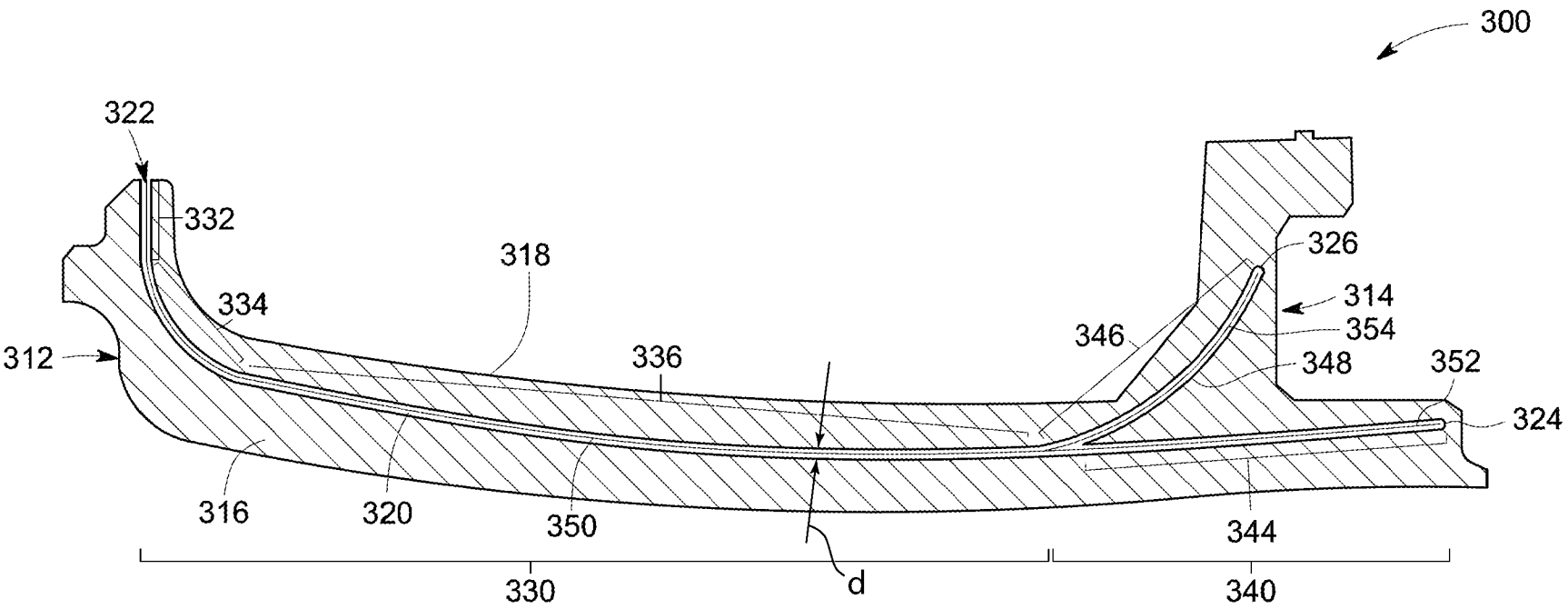
FIG. 4 is a perspective side view of an outer band of a turbine nozzle, in accordance with some embodiments of the disclosure.

FIG. 4 shows a cross sectional view of an outer band 300 of the turbine nozzle 110 (FIG. 3). Referring to FIG. 4, the outer band 300 has a forward surface 312, an aft surface 314, a pressure side surface 316, and a suction side surface 318 (not visible in FIG. 4). The forward surface 312 may be defined by a facing of the outer band 300 that is perpendicular to the flow path 25 of the gas turbine 10 (FIG. 1). The forward surface 312 may face the installer when the stator assembly 100 is assembled in the gas turbine 10. The aft surface 314 may be defined by a facing of the outer band 300 that is perpendicular to the flow path 25, and is situated later (downstream) in the flow path 25 as compared to the forward surface 312. The aft surface 314 faces away from the installer when the stator assembly 100 is assembled in the gas turbine 10. The pressure side surface 316 may be defined by a facing of the outer band 300 that is perpendicular to the axis 28 and facing an adjacent turbine nozzle. The suction side surface 318 may be defined by a facing of the outer band 300 that is perpendicular to the axis 28 and facing an adjacent turbine nozzle.

The outer band 300 has a length measured in the general direction of the flow path 25 from the forward most feature of the forward surface 312 to the aft most feature of the aft surface 314. Note that this body length includes projecting surface features that may not be considered integral to the outer band 300. The body length may be defined as the distance from the forward most portion of a theoretically planar forward surface (extending from the forward edge of the back-side surface 304 to the forward edge of the gas-side surface 302) to the aft most portion of a theoretically planar aft surface (extending from the aft edge of the back-side surface 304 to the aft edge of the gas-side surface 302) on a line parallel with the axis 28. The outer band 300 has a body height substantially perpendicular to the body length. The body height can be measured from the back-side surface 304 to the gas-side surface 302 of the outer band 300.

The outer band 300 in FIG. 4 is shown in side view without an adjacent outer band (of an adjacent turbine nozzle) that would otherwise obscure the features of the pressure side surface 316. A portion of a seal channel 320 and a plurality of seal layers 350 are shown as they would appear after installation. In some embodiments, the adjacent outer band would be positioned against the pressure side surface 316 prior to installation of the plurality of seal layers 350.

As illustrated in FIG. 4, the outer band 300 includes the portion of the seal channel 320 on the pressure side surface 316. The seal channel 320 is partially defined by a recess in the pressure side surface 316 of the outer band 300. The seal channel 320 is further defined by a similar and complementary recess (i.e., another portion of the seal channel 320) in the suction side surface of the adjacent outer band 300 (not shown in FIG. 4) disposed adjacent to the pressure side surface 316 of the outer band 300 (FIG. 3). Similarly, the outer band 300 would have a complementary recess (not shown) on the suction side surface 318 to define another seal channel with the pressure side surface of the adjacent outer band disposed adjacent to the suction side surface 318 of the outer band 300. The seal channel 320 extends along a direction from the forward surfaces (e.g., 312) to the aft surfaces (e.g., 314) of outer band 300 and the adjacent outer band. The seal channel 320 has an open forward end 322 proximate to the forward surface 312 and at least two rear ends 324 and 326 proximate to the aft surface 314 of the outer band 300. The open forward end 322 may open to the back-side surface 304 of the outer band 300 and proximate to the forward surface 312. The open forward end 322 provides an opening through which the plurality of seal layers 350 is inserted into the seal channel 320. The seal channel 320 is described with respect to the partial features of the portion of the seal channel 320 shown in FIG. 4. The features of the seal channel 320 are further defined by the similar and complementary recess in the suction side surface of the adjacent outer band (not shown) disposed adjacent to the pressure side surface 316 of the outer band 300. The similar and complementary portion of the seal channel on the adjacent outer band will complete the seal channel 320.

As shown in illustrated embodiment, the seal channel 320 extends substantially along both the body length and the body height of the outer band 300. In this context, extending substantially along means that the seal channel 320 traverses the majority of the body length and the majority of the body height. In one embodiment, the seal channel 320 extends along at least 85% of the body length and at least 85% of the body height.

Referring to FIG. 4, the seal channel 320 has a forward portion 330 and a rear portion 340. The forward portion 330 extends from the open forward end 322 to the rear portion 340, and the rear portion 340 extends in continuation with the forward portion 330 towards the aft surface 314. The forward portion 330 includes a vertical portion 332 extending from the open forward end 322 to a connecting portion 334. The forward portion 330 further includes a lateral portion 336 extending from the connecting portion 334 to the rear portion 340. In one embodiment, the connecting portion 334 may be curved (as shown in FIG. 4) having a radius of curvature in a range from about 0.5 inch to about 2.5 inches, for example. The lateral portion 336 is substantially parallel to one or both the planes defined by the two or more edges of the back-side surface 304 and the gas-side surface 302 of outer band 300. In this context, substantially parallel means the majority of the lateral portion 336 being at an angle less than 20 degrees from at least one of the referenced planes. The lateral portion 336 and the vertical portion 332 are also substantially perpendicular to one another and their respective reference planes. In this context, substantially perpendicular means the majority of lateral portion 336 is at a 75-105 degree (90 degrees+/−15 degrees) angle from the majority of the vertical portion 332 and/or the aft surface plane. Similarly, substantially perpendicular means the vertical portion 332 is at a 75-105 degree angle from the majority of the lateral portion 336. The connecting portion 334 extends between and connects the lateral portion 336 to the vertical portion 332. In some embodiments, as illustrated, the connecting portion 334 is an arcuate channel between the lateral portion 336 and the vertical portion 332.

In some embodiments, as illustrated, the rear portion 340 splits into two rear sections: a first rear section 344 extending from the lateral portion 336 to the first rear end 324 and a second rear section 346 extending from the lateral portion 336 to the second rear end 326. The first and second rear sections (344, 346) may terminate at blind ends or include open ends. As illustrated, the first rear section 344 extends in continuation with the lateral portion 336 substantially parallel to the lateral portion 336. That is, the first rear section 344 extends substantially along the body length. The second rear section 346 extends in continuation with the lateral portion 336 and diverges with the first rear section 344. The first rear section 344 and the second rear section 346 diverge at an angle of at least 1 degree. In some embodiments, the angle of divergence is in a range from about 3 degrees to about 90 degrees. In some embodiments, the angle of divergence is in a range from about 10 degrees to about 70 degrees. In some embodiments, the second rear section 346 may be curved for example, as shown in FIG. 4 and have a convex surface 348 facing the first rear section 344. The curved second rear section 346 may have a radius of curvature in a range from about 0.5 inch to about 2.5 inches, for example.

In some embodiments, the seal channel 320 defined between the outer band 300 and an adjacent outer band may have a uniform thickness throughout its length. The thickness of the seal channel 320 can be defined as a width of the recess, and is shown as 'd' in FIG. 4. In some embodiments, the forward portion 330 and the first and second rear sections (344, 346) of the rear portion 340 may have different thicknesses. In some embodiments, at least one of the first rear section 344 or the second rear section 346 has a thickness equal to a thickness of the forward portion 330. In some embodiments, at least one of the first rear section 344 or the second rear section 346 has a thickness less than a thickness of the forward portion 330. Further, the first rear section 344 and the second rear section 346 may have same or different thicknesses. Moreover, the seal channel 320 needs not to have a uniform depth along its entire length in the pressure side surface 316 and the suction side surface of the adjacent outer band.

As alluded previously, the plurality of seal layers 350 can be inserted through the open forward end 322, travel through the vertical portion 332, the connecting portion 334, and the lateral portion 336, and guided to the first rear section 344 and the second rear section 346 to be terminated at the corresponding first and second rear ends 324 and 326. FIG. 4 shows only a portion of the seal channel 320 that will guide and locate the plurality of seal layers 350 when it is installed between outer band 300 and the adjacent outer band. A similar and complementary portion of seal channel on the adjacent outer band will complete the seal channel 320.

In FIG. 4, the plurality of seal layers 350 is shown in its installed configuration. The plurality of seal layers 350 are disposed within the seal channel 320 such that one or more seal layers 352 of the plurality of seal layers 350 extend from the open forward end 322 to the first rear end 324 and one or more other seal layers 354 of the plurality of seal layers 350 extend from the open forward end 322 to the second rear end 326. In some embodiments, the plurality of seal layers 350 substantially conforms the seal channel 320. That is, the one or more seal layers 352 conforms a portion of the seal channel 320 extending from the open forward end 322 to the first rear end 324 and the one or more other seal layers 354 conforms another portion of the seal channel 320 extending from the open forward end 322 to the second rear end 326.

A seal layer of the plurality of seal layer 350 may be a shim or laminated spline. For example, each seal layer may include a thin rectangular body for example, a strip, sheet or foil of a material, such as an alloy with a desired width, length, and thickness. Suitable materials for the plurality of seal layers 350 may be selected based upon their elastic properties, temperature tolerance, and other physical characteristics compatible with the environment in the flow path 25 of the turbomachine. Some examples of suitable materials include, but are not limited to, cobalt-based alloys such as Haynes® 188 alloy or Haynes® 25 alloy.

Individual seal layers of the plurality of seal layers 350 may be same or different in their thicknesses, lengths, materials, or may incorporate same or different desired characteristics such as elastic properties, flexibility, yield strength, oxidation resistance, or sealing characteristics to facilitate lamination, insertion, and retention. The elastic properties of a seal layer may depend; in part, on the material and the thickness of the seal layer. In some embodiments, individual seal layers of the plurality of seal layers 350 include same or different materials. In some embodiments, individual seal layers of the plurality of seal layers 350 have same or different thicknesses. Each seal layer of the plurality of seal layers 350 may have a thickness in a range from about 0.1 millimeter to about 1 millimeter, for example, depending on desired elastic properties of the individual seal layers. In some embodiments, each seal layer has a thickness in a range from about 0.2 millimeter to about 0.6 millimeter. In some embodiments, the one or more seal layers 352 has a thickness greater than a thickness of the one or more other seal layers 354. In some embodiments, the thickness of a seal layer of the plurality of seal layer 350 may vary along its length.

In some embodiments, the plurality of seal layers 350 may be flexible enough to follow a curved path of the seal channel 320 as shown in FIG. 4, when inserted. It may be desirable to have the one or more other seal layers 354 to be less flexible as compared to the one or more seal layers 352. For example, the one or more other seal layers 354 may be flexible enough to be inserted in the second rear section 346 (this may depend on the radius of curvature of the second rear section 346). In some embodiments, the one or more seal layers 352 has a plastic deformation lower than a plastic deformation of the one or more other seal layers 354. These characteristics may enable insertion of the one or more other seal layers 354 in the second rear section 346 of the seal channel 320.

Moreover, it may also be desirable that the one or more seal layers 352 have different oxidation resistance than that of the one or more other seal layers 354 depending on their locations in the gas turbine. The oxidation resistance of a seal layer may depend, in part, on the material of the seal layer. In some embodiments, the one or more seal layers 352 have higher oxidation resistance than that of the one or more other seal layers 354.

The numbers of the seal layers in the first rear section 344 and the second rear section 346 may depend on various parameters such as the thicknesses of seal layers, the flexibilities of seal layers, the thickness of the first rear section 344 and the second rear section 346, and the thickness of the forward portion 330 etc. In some embodiments, the total thickness of the plurality of seal layers 350 (the portions of the plurality of seal layers 350 that are disposed in forward portion 330) matches with the thickness of the forward portion 330. In some embodiments, the total thickness of the one or more seal layers 352 (the portions of the one or more seal layers 352 that are disposed in the first rear section 344) matches with the thickness of the first rear section 344. In some embodiments, the total thickness of the one or more other seal layers 354 (the portions of the one or more other seal layers 354 that are disposed in the second rear section 346) matches with the thickness of the second rear section 346.

Figure 5:
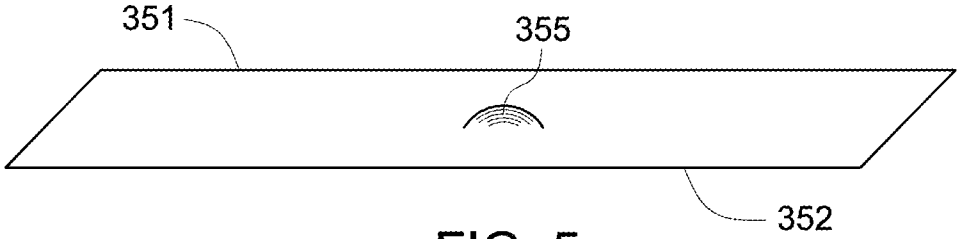
FIG. 5 shows a schematic of a seal layer having a discontinuity, in accordance with some embodiments of the disclosure.
Figure 6:
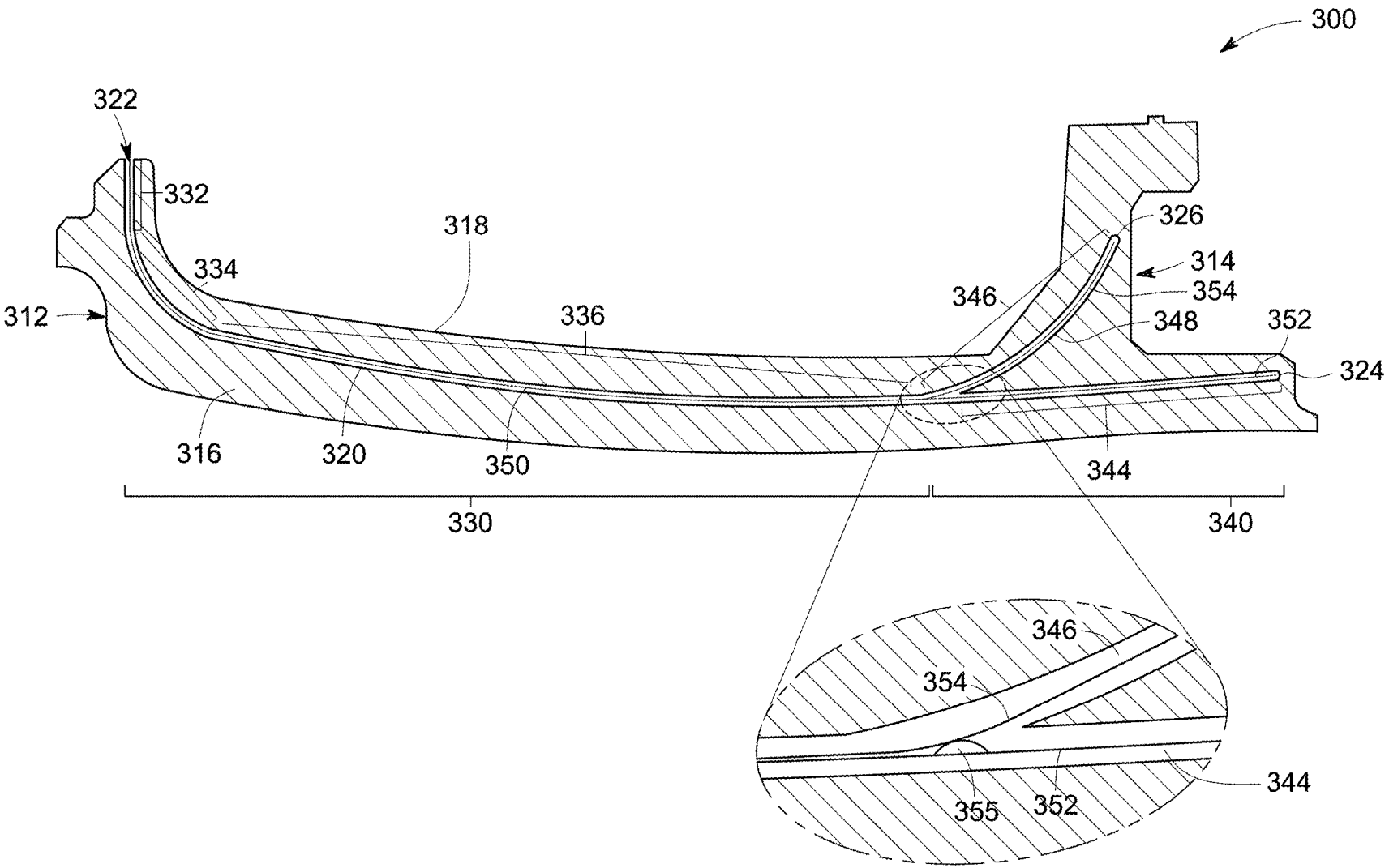
FIG. 6 is a perspective side view of an outer band of a turbine nozzle, in accordance with some embodiments of the disclosure.

In some embodiments, a seal layer of the one or more seal layers 352 has a discontinuity at a position such that the discontinuity is located in the lateral portion 336 of the seal channel 320 when installed in the seal channel 320. As used herein, the term "discontinuity" refers to an interruption in the normal physical structure or configuration of a seal layer. The discontinuity may include a change in surface structure of the seal layer. For example, the discontinuity may be a gap, a cut, a bump, or an external feature add to the surface of the seal layer. For example, a seal layer 352 having a bump 355 on a surface 351 of the seal layer 352 is shown in FIG. 5. In some embodiments, the discontinuity is located at a portion of the seal layer (disposed in the seal channel) that is proximate to the rear portion 340 where the seal channel 320 splits into the first rear section 344 and the second rear section 346. Further, in some embodiments, the seal layer with the discontinuity is the top most seal layer of the one or more seal layers 152 that are inserted in the first rear section 144. This discontinuity may help in guiding a subsequent seal layer inserted into the seal channel 320 to travel to the second rear section 346 while disposing the one or more other seal layer 354. For example, FIG. 6 shows a view when a seal layer 354 is inserted in the seal channel 320, the bump 355 on the surface 351 of the seal layer 352 that is placed in the seal channel previously, helps in guiding the seal layer 354 into the second rear section 346.

The one or more seal layers 352 and the one or more other seal layers 354 may be connected to one another for retention. In some embodiments, the plurality of seal layers 350 may be connected at their front ends that are located near the open forward end 322 of the seal channel 320. The plurality of seal layers 350 may be connected for example, by welding prior to or after insertion of the plurality of seal layers 350 in the seal channel 320. For example, the front ends of the plurality of seal layer 350 may be connected after insertion. Other shapes, configurations, attachment between the seal layers, number of seal layers, and shaping of one or both ends of the seal layers may also be desirable for specific embodiments and retention of the plurality of seal layer.

Figure 7:
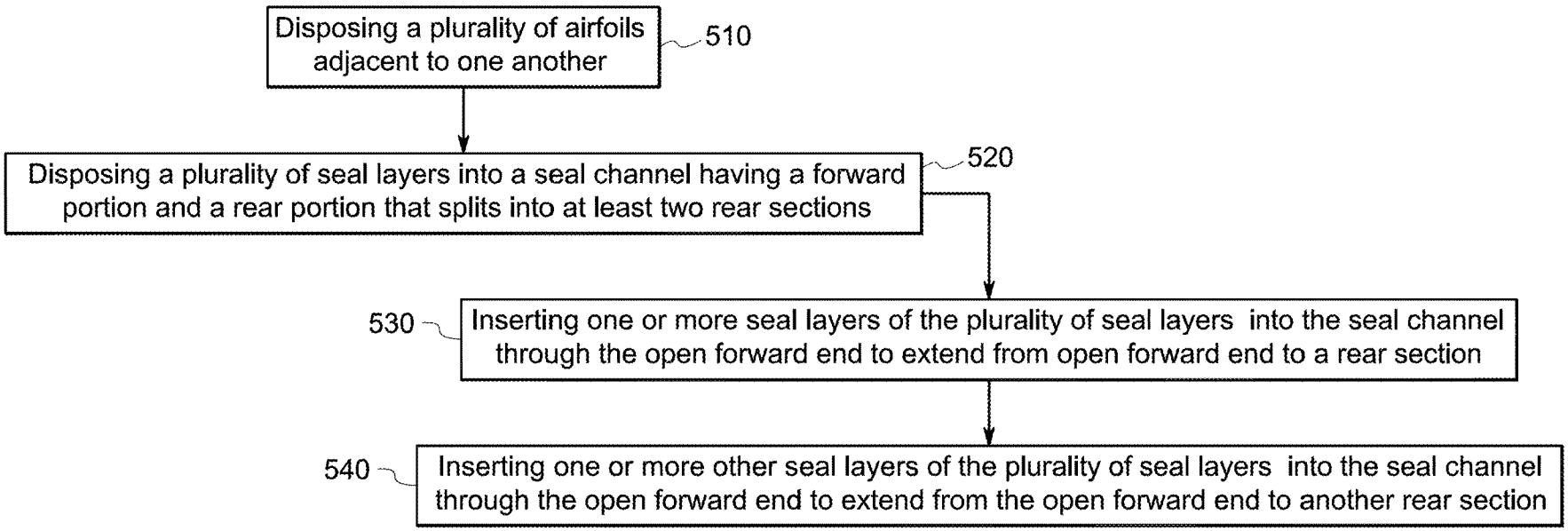
FIG. 7 shows a flow chart of a method for sealing adjacent turbine nozzles to form a stator assembly, in accordance with some embodiments of the disclosure.

FIG. 7 shows a method 500 of assembling a plurality of flow path components such as turbine nozzles 110 to form an assembly, such as the stator assembly 100 of a turbomachine as shown in preceding Figures. In the step 510, the method 500 includes disposing a plurality of flow path components such as turbine nozzles 110 adjacent to one other. In some embodiments, the plurality of turbine nozzles 110 is disposed circumferentially about the axis 28 (FIG. 1). In the step 520, the method 500 includes disposing a plurality of seal layers 350 into the seal channel 320. The details of the seal channel 320 are described previously. In the step 520, the disposing the plurality of seal layers 350 is performed by inserting the plurality of seal layer 350 into the seal channel through the open forward end 322.

The step 520 includes a sub-step 530 of inserting one or more seal layers 352 of the plurality of seal layers 350 into the seal channel 320 through the open forward end 322 to dispose the one or more seal layers 352 extending from the open forward end 322 to the first rear end 324. The step 520 further includes another sub-step 540 of inserting one or more other seal layers 354 of the plurality of seal layers 350 into the seal channel 320 through the open forward end 322 to dispose the one or more other seal layers 354 extending from the open forward end 322 to the second rear end 326.

In some embodiments, the step 520 of disposing includes subsequently inserting the one or more seal layers 352 and the one or more other seal layers 354. In some embodiments, the sub-step 530 of inserting the one or more seal layers 352 is performed prior to the sub-step 540 of inserting the one or more other seal layers 354. In some embodiments, each seal layer the plurality of seal layers 350 may be inserted one by one. For example, the method 500 first includes inserting a seal layer of the plurality of seal layers 350 through the open forward end 322, moving through the forward portion 330, moving through the first rear section 344 until the inserted end of the seal layer reaches the first rear end 324 of the seal channel 320. The method 500 may include repeating this step of inserting a seal layer at least one more time depending on the desirable number of seal layers inserted in the first rear section 344. Continuing this example, after the seal layer or layers 352 are inserted into the first rear end 344, a seal layer 354 is then inserted through the open forward end 322 that moves through the forward portion 330, moves through the second rear section 346 until the inserted end of the seal layer 354 reaches the second rear end 326 of the seal channel 320. In some embodiments, in this step, the seal layer 354 may be guided into the second rear section 346 (after travelling the forward portion 330) by using a discontinuity in the previously inserted seal layer 352 into the first rear section 344. The discontinuity in the previously inserted seal layer 352 may guide a subsequent seal layer (i.e., the seal layer 354) to move into the second rear section 346 (as shown in FIG. 6). In some embodiments, the method 500 further includes inserting additional seal layers of the one or more other seal layers 354 into the seal channel 320.

The plurality of seal layers 350 substantially seals the potential leak path between two adjacent outer bands. Being substantially sealed reduces the total potential leak path between the outer bands by at least 85% compared to the leak path between outer bands without the seal. A substantially complete outer band seal reduces the leak path between the outer bands of adjacent turbine nozzles by at least 99%. In some embodiments, the method may further include connecting the plurality of seal layers at their front ends (that are located at the open forward end 322) after insertion of the plurality of seal layers 350. This may help in securely retaining the plurality of seal layers 350 in place during operation of the gas turbine in which they are installed. A similar process could be achieved between the inner bands of the turbine nozzles and other flow path components that are installed in segments and leave a seam in need of sealing.

In conventional sealing arrangements, several rigid seals such as rigid seal sheets are joined end to end to be installed along a curved seal channel between the outer bands of turbine nozzles when a plurality of turbine nozzles are assembled circumferentially adjacent to one another in a stator assembly. There are several disadvantages in using these straight seals including complex assembly process and chances of disengagement of several joints at different time during the operation. In addition, these rigid seals cannot be removed easily without disassembling the stator assembly and there is risk of falling out a small seal such as a discourager seal. In contrast to those conventional arrangements, embodiments of the present disclosure provide simple and improved installation of flexible seals between the flow path components of a turbomachine. The adjacent flow path components are designed to define an opening at an open forward end of the seal channel between them for receiving and removing the flexible seal layers. This provides ease of installing and removing the seal layers from a curved seal channel without disassembling the stator assembly. The use of flexible seal layers advantageously reduces (i) the number of rigid seals (i.e. number of pieces) inserted in the seal channel along the seal length and (ii) reduces the chances of missing a leak path between the flow path components such as outer bands while manufacturing. In addition, a distance between the flow path of a turbomachine and a bottom side of a seal channel of a flow path component can be reduced by having the seal channel curved. The use of flexible seal layer(s) enables sealing of curved seal channels and thus allows to have curved seal channels in the flow path components such as the inner and outer bands of turbine nozzles. A reduction in the distance between the flow path and the bottom side of a seal channel of a flow path component allows to minimize purge air requirement to cool it.

The foregoing drawings show some of the operational processing associated according to several embodiments of this disclosure. It should be noted that in some alternative implementations, the acts described may occur out of the order described or may in fact be executed substantially concurrently or in the reverse order, depending upon the act involved.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An assembly of a turbomachine, comprising:

a plurality of flow path components disposed adjacent to one another, each flow path component of the plurality of flow path components having a forward surface, an aft surface, a pressure side surface, and a suction side surface;

a seal channel defined by the pressure side surface of a flow path component of the plurality of flow path components and the suction side surface of an adjacent flow path component of the plurality of flow path components and extending from the forward surfaces to the aft surfaces of the flow path components; wherein the seal channel has an open forward end proximate to the forward surfaces and at least two rear ends proximate to the aft surfaces of the flow path components; and a plurality of seal layers disposed within the seal channel such that one or more seal layers of the plurality of seal layers extend from the open forward end to a rear end of the at least two rear ends and one or more other seal layers of the plurality of seal layers extend from the open forward end to another rear end of the at least two rear ends, wherein the one or more seal layers have a plastic deformation lower than a plastic deformation of the one or more other seal layers.

2. The assembly of claim 1, wherein the seal channel extends from the open forward end and splits into at least two rear sections terminating at the at least two rear ends.

3. The assembly of claim 2, wherein the at least two rear sections diverge at an angle of at least 1 degree.

4. The assembly of claim 3, wherein the angle is in a range from about 3 degrees to about 90 degrees.

5. The assembly of claim 2, wherein at least one rear section of the at least two rear sections has a thickness less than a thickness of the seal channel at the open forward end.

6. The assembly of claim 1, wherein the plurality of seal layers substantially conforms to the seal channel.

7. The assembly of claim 1, wherein the one or more seal layers has an oxidation resistance higher than an oxidation resistance of the one or more other seal layers.

8. The assembly of claim 1, wherein the one or more seal layers has a thickness greater than a thickness of the one or more other seal layers.

9. The assembly of claim 1, wherein each seal layer of the plurality of seal layers has a thickness in a range from about 0.1 millimeter to about 1 millimeter.

10. A method for assembling a plurality of flow path components, comprising:

disposing the plurality of flow path components adjacent to each other, each flow path component of the plurality of flow path components having a forward surface, an aft surface, a pressure side surface, and a suction side surface, such that a seal channel is defined by the pressure side surface of a flow path component of the plurality of flow path components and the suction side surface of an adjacent flow path component of the plurality of flow path components, which extends from the forward surfaces to the aft surfaces of the flow path components and wherein the seal channel has an open forward end proximate to the forward surfaces and at least two rear ends proximate to the aft surfaces of the flow path components; and disposing a plurality of seal layers into the seal channel by:

inserting one or more seal layers of the plurality of seal layers into the seal channel through the open forward end to dispose the one or more seal layers extending from the open forward end to a rear end of the at least two rear ends; and inserting one or more other seal layers of the plurality of layers into the seal channel through the open forward end to dispose the one or more other seal layers extending from the open forward end to another rear end of the at least two rear ends, wherein the one or more seal layers have a plastic deformation lower than a plastic deformation of the one or more other seal layers.

11. The method of claim 10, wherein the seal channel extends from the open forward end and splits into at least two rear sections terminating at the at least two rear ends.

12. The method of claim 11, wherein the at least two rear sections diverge at an angle of at least 1 degree.

13. The method of claim 10, wherein the one or more seal layers has an oxidation resistance higher than an oxidation resistance of the one or more other seal layers.

14. The assembly of claim 10, wherein the one or more seal layers has a thickness greater than a thickness of the one or more other seal layers.

15. The method of claim 10, wherein the step of disposing comprises subsequently inserting the one or more seal layers and the one or more other seal layers.

16. An assembly of a turbomachine, comprising:

a plurality of flow path components disposed adjacent to one another, each flow path component of the plurality of flow path components having a forward surface, an aft surface, a pressure side surface, and a suction side surface;

a seal channel defined by the pressure side surface of a flow path component of the plurality of flow path components and the suction side surface of an adjacent flow path component of the plurality of flow path components and extending from the forward surfaces to the aft surfaces of the flow path components; wherein the seal channel has an open forward end proximate to the forward surfaces and at least two rear ends proximate to the aft surfaces of the flow path components; and a plurality of seal layers disposed within the seal channel such that one or more seal layers of the plurality of seal layers extend from the open forward end to a rear end of the at least two rear ends and one or more other seal layers of the plurality of seal layers extend from the open forward end to another rear end of the at least two rear ends, wherein a seal layer of the one or more seal layers of the plurality of seal layers comprises a discontinuity configured to guide the one or more other seal layers of the plurality of seal layers into one of the at least two rear ends, wherein the one or more seal layers have an oxidation resistance higher than an oxidation resistance of the one or more other seal layers.

17. The assembly of claim 16, wherein the discontinuity comprises at least one of a gap, a cut, a bump, and an external feature.

18. The assembly of claim 16, wherein the discontinuity comprises a bump.

* * * * *